US008311463B2

(12) United States Patent
Stelter

(10) Patent No.: US 8,311,463 B2
(45) Date of Patent: Nov. 13, 2012

(54) METHOD AND SYSTEM TO REDUCE HIGH-FREQUENCY BANDING FOR ELECTROPHOTOGRAPHIC DEVELOPMENT STATIONS

(75) Inventor: Eric C. Stelter, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 480 days.

(21) Appl. No.: 12/542,750

(22) Filed: Aug. 18, 2009

(65) Prior Publication Data

US 2011/0044728 A1 Feb. 24, 2011

(51) Int. Cl.
*G03G 15/09* (2006.01)

(52) U.S. Cl. ..... 399/267

(58) Field of Classification Search ..... 399/267, 399/276

See application file for complete search history.

(56) References Cited

U.S. PATENT DOCUMENTS 6,101,357 A 8/2000 Wayman
6,142,690 A * 11/2000 Yoshimura et al. ..... 400/636.2
6,236,820 B1 5/2001 Nakazato et al.
6,526,247 B2 2/2003 Stelter et al.
6,567,110 B2 5/2003 Yergenson
6,728,503 B2 4/2004 Stelter et al.
6,775,505 B2 8/2004 Stelter et al.
6,946,230 B2 9/2005 Stelter et al.
6,959,162 B2 10/2005 Stelter et al.
7,280,779 B2 10/2007 Fasen
2003/0099489 A1 5/2003 Meyer et al.
2004/0096244 A1 5/2004 Kadota et al.

* cited by examiner

*Primary Examiner* — Joseph S Wong
(74) *Attorney, Agent, or Firm* — Donna P. Suchy; Christopher J. White

(57) ABSTRACT

A method for reducing high-frequency banding in an electrophotographic development station having a rotating shell and a photoconductor is disclosed. A rotating speed of the rotating shell is adjusted relative to a photoconductor such that a banding reduction ratio is not a ratio of differing low whole numbers. Another method for reducing high-frequency banding in an electrophotographic development station having a rotating shell and a rotating magnetic core is also disclosed. A rotating speed of the rotating shell is adjusted relative to a rotating speed of the rotating magnetic core such that from the point of view of a spot on a dielectric support member (DSM) in a nip region of the DSM, a similar point on the rotating shell is substantially in alignment with the DSM spot in the nip region when a pole flip occurs.

16 Claims, 6 Drawing Sheets

METHOD AND SYSTEM TO REDUCE HIGH-FREQUENCY BANDING FOR ELECTROPHOTOGRAPHIC DEVELOPMENT STATIONS

CROSS REFERENCE TO RELATED APPLICATIONS

This application relates to commonly assigned, copending U.S. application Ser. No. 12/542,757, filed Aug. 18, 2009, entitled: "HIGH-FREQUENCY BANDING REDUCTION FOR ELECTROPHOTOGRAPHIC PRINTER."

FIELD OF THE INVENTION

The claimed invention relates in general to electrophotographic imaging systems, and more particularly to a method and system for reducing high-frequency banding in electrophotographic imaging systems.

BACKGROUND OF THE INVENTION

In typical commercial electrographic printing or reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles (for example, toner) are manipulated into close proximity with the latent image charge pattern by a one or more development stations, allowing the pigmented marking particles to be attracted to the latent image charge pattern in order to develop such image on the dielectric support member. A receiver member, such as a sheet of paper, transparency or other medium, is then brought directly or indirectly via an intermediate transfer member, into contact with the dielectric support member, and an electric field is applied to transfer the marking particle developed image to the receiver member from the dielectric support member. After transfer, the receiver member bearing the transferred image is transported away from the dielectric support member, and the image is fixed (fused) to the receiver member by heat and/or pressure to form a permanent image thereon.

The development system of an electrophotographic printing or reproduction apparatus is ideally designed to provide a uniform toner concentration to the passing dielectric support member so that a uniformly charged latent image on the dielectric support member will be developed with a proportionally uniform density of toner. Unfortunately, many existing electrophotographic development stations produce "banding", which is a noticeable and an undesirable variation in image density that manifests as alternating or varying density bands in areas which otherwise are supposed to have a uniform density.

Previous attempts at preventing or reducing banding have sometimes increased the overall developed image density (for example by increasing toner concentration) to a point where any variation in developed density is unnoticeable in dark image regions since the image appears uniformly saturated to a viewer, thereby hiding banding effects in those dark regions. Unfortunately, such techniques can lead to dusting and/or unwanted background toner in light or white areas.

Other attempts to reduce banding have focused on trying to manipulate or control one or more development station electrical biases to compensate for banding. For example, U.S. Pat. No. 6,101,357 discloses a method for reducing power-supply-induced banding by modulating an AC oscillation voltage in a way which minimizes electrical energy in a frequency spectrum that was found to contribute to certain kinds of banding. Similarly, U.S. Pat. No. 7,280,779 discloses a method of measuring an electrical potential on the surface of a developer roll and adjusting a time varying component of a voltage applied to the developer roller using the measured potential in order to reduce variation in the electrical potential and thereby reduce banding.

Further attempts at reducing banding have focused on trying to minimize vibrations or movement of the development station relative to the dielectric support member since variations in development station spacing can cause banding. For example, U.S. Pat. No. 6,236,820 discloses an imaging system which physically links key image subsystems to the one or more development stations in a way which minimizes their movements relative to each other, thereby reducing banding.

Still further attempts at reducing banding have shied away from identifying and addressing a root cause for the banding and instead have taken measures to introduce system noise in attempt to mask banding effects. For example, U.S. Pat. No. 6,567,110 discloses a method for coupling a noise generator to a component in a laser imaging assembly in order to create noise in the pre-developed latent image. Unfortunately, while the noise in the latent image may help obfuscate development banding effects, it is merely masking a problem and necessarily adds system cost through the need of yet more subsystem components.

Furthermore, while previous attempts to prevent development station banding may have focused on modifying the electrical development bias, the persistence of banding under a variety of bias conditions indicates that development station banding still remains an incompletely understood problem which requires further study.

Therefore, it would be beneficial if there were an inexpensive, yet reliable, method and system for reducing development station banding that could easily be implemented.

SUMMARY OF THE INVENTION

In view of the above, the claimed invention is directed towards a method for reducing high-frequency banding in an electrophotographic development station having a rotating shell and a magnetic core, such as a rotating magnetic core. A rotating speed of the rotating shell is adjusted relative to a rotating speed of the rotating magnetic core and the speed of the dielectric support member such that a banding reduction ratio is not a ratio of differing low whole numbers.

The claimed invention is also directed towards a development system. The development system has a rotating development shell and a rotating magnetic core at least partially within the rotating development shell. The development system also has at least one drive configured to rotate the rotating development shell and the rotating magnetic core relative to each other and relative to the speed of the dielectric support member such that a banding reduction ratio is not a ratio of differing low whole numbers.

The claimed invention is further directed towards another method for reducing high-frequency banding in an electrophotographic development station having a rotating shell and a rotating magnetic core. A rotating speed of the rotating shell is adjusted relative to a rotating speed of the rotating magnetic core for a given speed of the dielectric support member such that from the point of view of a spot on a dielectric support member (DSM) in a nip region of the DSM that was at the center of the nip when a pole flip occurred, a similar point on the rotating shell is not substantially in alignment with the DSM spot in the nip region when a subsequent pole flip occurs. If a portion of the DSM was at the center of the nip during a pole flip, a band will occur if, at a subsequent pole flip, that portion of the DSM is adjacent another portion of the rotating shell that was in the center of the nip during a previous pole flip.

The invention, and its objects and advantages, will become more apparent in the detailed description of the preferred embodiment presented below.

Figure 1:
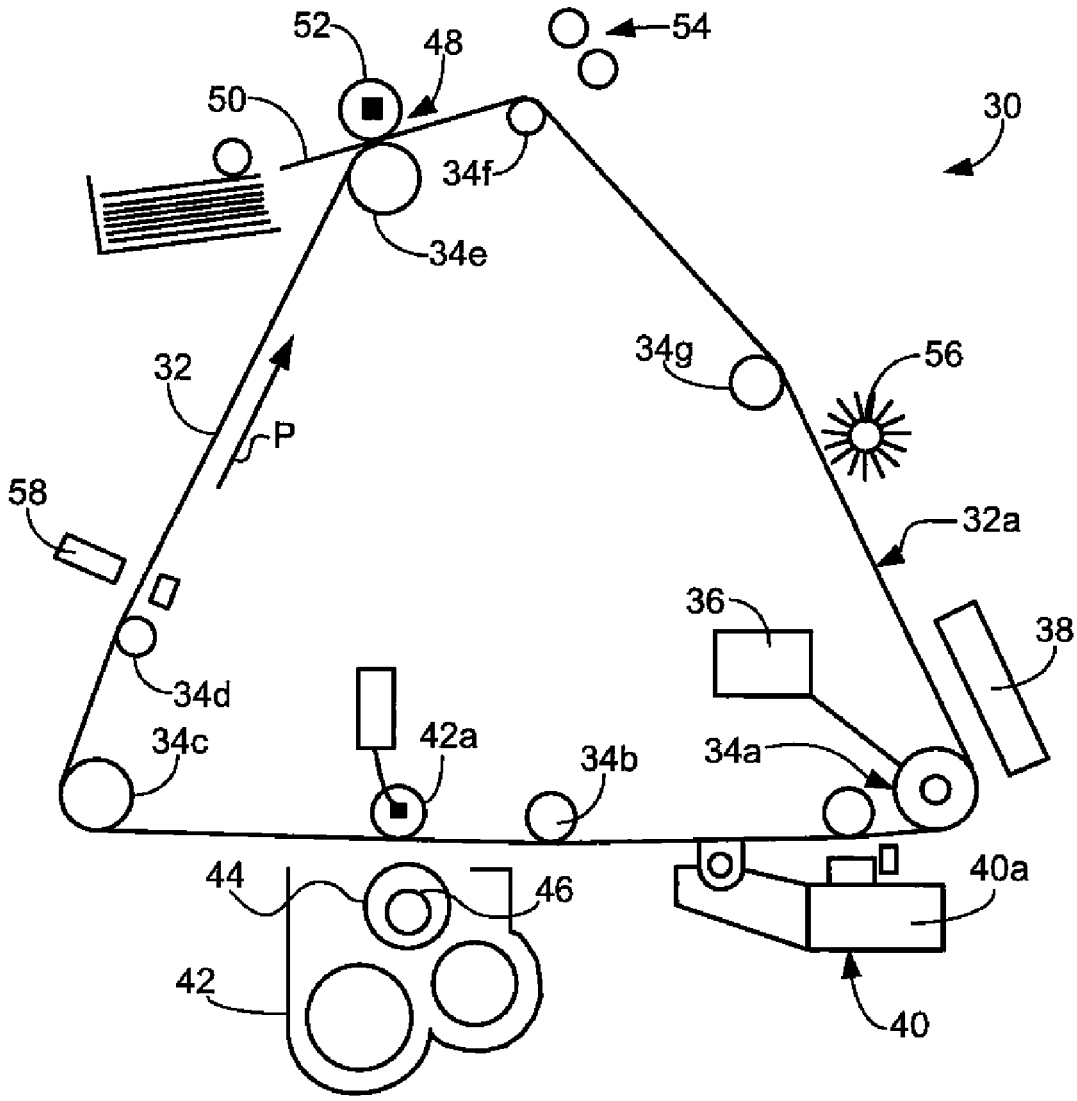
FIG. 1 schematically illustrates an embodiment of an electrophotographic print engine.

It will be appreciated that for purposes of clarity and where deemed appropriate, reference numerals have been repeated in the figures to indicate corresponding features, and that the various elements in the drawings have not necessarily been drawn to scale in order to better show the features.

DETAILED DESCRIPTION OF THE INVENTION

FIG. 1 schematically illustrates an embodiment of an electrophotographic print engine 30. The print engine 30 has a movable recording member such as a photoconductive belt 32 which is entrained about a plurality of rollers or other supports 34*a* through 34*g*. The photoconductor can be either a drum or a photoconductive belt 32 and may be more generally referred-to as a type of dielectric support member (DSM) 32. A dielectric support member (DSM) 32 may be any charge carrying substrate which may be selectively charged or discharged by a variety of methods including, but not limited to corona charging/discharging, gated corona charging/discharging, charge roller charging/discharging, ion writer charging, light discharging, heat discharging, and time discharging. The invention can be used in conjunction with other dielectric support members that are not image-wise exposed using light.

One or more of the rollers 34*a*-34*g* are driven by a motor 36 to advance the DSM 32. Motor 36 preferably advances the DSM 32 at a high speed, such as 20 inches per second or higher, in the direction indicated by arrow P, past a series of workstations of the print engine 30, although other operating speeds may be used, depending on the embodiment. In some embodiments, DSM 32 may be wrapped and secured about only a single drum. In further embodiments, DSM 32 may be coated onto or integral with a drum.

Print engine 30 may include a controller or logic and control unit (LCU) (not shown). The LCU may be a computer, microprocessor, application specific integrated circuit (ASIC), digital circuitry, analog circuitry, or a combination or plurality thereof. The controller (LCU) may be operated according to a stored program for actuating the workstations within print engine 30, effecting overall control of print engine 30 and its various subsystems. The LCU may also be programmed to provide closed-loop control of the print engine 30 in response to signals from various sensors and encoders. Aspects of process control are described in U.S. Pat. No. 6,121,986 incorporated herein by this reference.

A primary charging station 38 in print engine 30 sensitizes DSM 32 by applying a uniform electrostatic corona charge, from high-voltage charging wires at a predetermined primary voltage, to a surface 32*a* of DSM 32. The output of charging station 38 may be regulated by a programmable voltage controller (not shown), which may in turn be controlled by the LCU to adjust this primary voltage; for example, by controlling the electrical potential of a grid and thus controlling movement of the corona charge. Other forms of chargers, including brush or roller chargers, may also be used.

An image writer, such as exposure station 40 in print engine 30 projects light from a writer 40*a* to DSM 32. This light selectively dissipates the electrostatic charge on photoconductive DSM 32 to form a latent electrostatic image of the document to be copied or printed. Writer 40*a* is preferably constructed as an array of light emitting diodes (LEDs), or alternatively as another light source such as a laser or spatial light modulator. Writer 40*a* exposes individual picture elements (pixels) of DSM 32 with light at a regulated intensity and exposure, in the manner described below. The exposing light discharges selected pixel locations of the photoconductor, so that the pattern of localized voltages across the photoconductor corresponds to the image to be printed. An image is a pattern of physical light which may include characters, words, text, and other features such as graphics, photos, etc. An image may be included in a set of one or more images, such as in images of the pages of a document. An image may be divided into segments, objects, or structures each of which is itself an image. A segment, object or structure of an image may be of any size up to and including the whole image.

After exposure, the portion of DSM 32 bearing the latent charge images travels to a development station 42. Development station 42 includes a rotating shell 44 in juxtaposition to the DSM 32. The rotating shell 44 surrounds a magnetic core which is shown in FIG. 1 as a rotating magnetic core 46 that helps magnetic toner (not shown in this view) adhere to the rotating shell 44. Plural development stations 42 may be provided for developing images in plural grey scales, colors, or from toners of different physical characteristics. Other embodiments include a development station having a rotating shell, a moving photoconductor, and a stationary magnetic core such that the speed relationships described below are made between the rotating shell and the moving photoconductor. Full process color electrographic printing is accomplished by utilizing this process for each of four toner colors (e.g., black, cyan, magenta, and yellow).

Upon the imaged portion of DSM 32 reaching development station 42, the LCU selectively activates development station 42 to apply toner to DSM 32 by moving backup roller 42*a* and DSM 32, into engagement with or close proximity to the rotating shell 44. Alternatively, the development station 42 and/or the rotating shell 44 may be moved toward DSM 32 to selectively engage DSM 32. In still other embodiments, neither the development station 42, the rotating shell 44, the DSM 32, nor the backup roller 42*a* are moved. Instead, the development station may be activated by switching electrical biases on/off. In any of the above cases, charged toner particles on the rotating shell 44 are selectively attracted to the latent image patterns present on DSM 32, developing those image patterns. As the exposed photoconductor passes the developing station, toner is attracted to pixel locations of the photoconductor and as a result, a pattern of toner corresponding to the image to be printed appears on the photoconductor. As known in the art, conductor portions of development station 42, such as conductive applicator cylinders, are biased to act as electrodes. The electrodes are connected to a variable supply voltage, which is regulated by a programmable controller in response to the LCU, by way of which the development process is controlled.

Development station 42 may contain a two component developer mix which comprises a dry mixture of toner and carrier particles. Typically the carrier preferably comprises high coercivity (hard magnetic) ferrite particles. As a non-limiting example, the carrier particles may have a volume-weighted diameter of approximately 30μ. The dry toner particles are substantially smaller, on the order of 6μ to 15μ in volume-weighted diameter. The rotating magnetic core 46 and the rotating shell 44 may be rotatably driven by a motor or other suitable driving means. Relative rotation of the core 46 and shell 44 moves the developer through a development zone in the presence of an electrical field. In the course of development, the toner selectively electrostatically adheres to DSM 32 to develop the electrostatic images thereon and the carrier material remains at development station 42. As toner is depleted from the development station due to the development of the electrostatic image, additional toner may be periodically introduced by a toner auger into development station 42 to be mixed with the carrier particles to maintain a uniform amount of development mixture. This development mixture is controlled in accordance with various development control processes. Single component developer stations (those having magnetized toner without a separate carrier), as well as conventional liquid toner development stations, may also be used. For simplicity, developer is used in the following discussions to refer to single-component developer or two-component developer, however, it should be understood that either single component developer or two-component developer may be used with the embodiments described herein and with the claimed invention.

A transfer station 48 in printing engine 30 moves a receiver sheet 50 into engagement with the DSM 32, in registration with a developed image to transfer the developed image to receiver sheet 50. Receiver sheets 50 may be plain or coated paper, plastic, or another medium capable of being handled by the print engine 30. Typically, transfer station 48 includes a charging device for electrostatically biasing movement of the toner particles from DSM 32 to receiver sheet 50. In this example, the biasing device is roller 52, which engages the back of sheet 50 and which may be connected to a programmable voltage controller that operates in a constant current mode during transfer. Alternatively, an intermediate member may have the image transferred to it and the image may then be transferred to receiver sheet 50. After transfer of the toner image to receiver sheet 50, sheet 50 is detacked from DSM 32 and transported to fuser station 54 where the image is fixed onto sheet 50, typically by the application of heat and/or pressure. Alternatively, the image may be fixed to sheet 50 at the time of transfer.

A cleaning station 56, such as a brush, blade, or web is also located beyond transfer station 48, and removes residual toner from DSM 32. A pre-clean charger (not shown) may be located before or at cleaning station 56 to assist in this cleaning. After cleaning, this portion of DSM 32 is then ready for recharging and re-exposure. Of course, other portions of DSM 32 are simultaneously located at the various workstations of print engine 30, so that the printing process may be carried out in a substantially continuous manner.

A controller provides overall control of the apparatus and its various subsystems with the assistance of one or more sensors which may be used to gather control process input data. One example of a sensor is belt position sensor 58.

Figure 2:
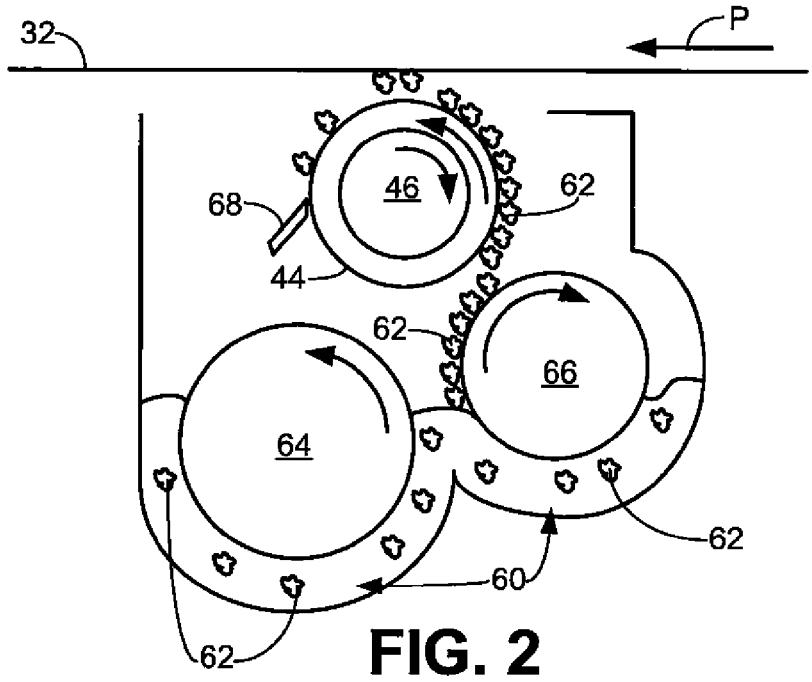
FIG. 2 schematically illustrates an embodiment of a development station 42 having a rotating shell 44 and a rotating magnetic core 46.

FIG. 2 schematically illustrates an embodiment of a development station 42 having a rotating shell 44 and a rotating magnetic core 46. In this embodiment, the development station 42 has a sump region 60 where developer (either single component or two component developer) remains available for use in development. Again, for simplicity, a single component developer is illustrated here, such as a toner 62 containing ferrous material which will respond to magnetic fields. The development station 42 may have one or more mixing devices 64, such as an auger or one or more paddles which rotate in contact with the toner 62 in the sump region 60, stirring the toner 62 and causing the toner 62 to develop a triboelectric charge from the mixing motion. One or more donor rolls 66 may be magnetized and/or electrically biased to pull toner 62 from the sump region 60 and deliver it to the rotating shell 44. Depending on the embodiment, the donor roll 66 may rotate in the same direction as the rotating shell 44 or in a direction opposite the rotating shell 44. The toner 62 adheres to the rotating shell 44 due to the magnetic fields created by the rotating magnetic core 46 located within the rotating shell 44. In this embodiment, the rotating shell 44 is rotating in a direction such that the surface of the rotating shell in proximity to the DSM 32 is moving in substantially the same direction as the moving DSM 32. An electrical bias applied between the rotating shell 44 and the DSM 32 enables the charged toner 62 to selectively overcome the magnetic force holding the toner 62 to the rotating shell 44 in areas defined by the latent charge image on the DSM 32, thereby adhering to the DSM 32 in the image areas. A skiving blade 68 may be positioned relative to the rotating shell 44 such that any untransferred developer 62 may be substantially removed from the rotating shell 44 prior to the rotating shell 44 rotating further to pick up more developer 62 from the donor roll 66. It should be noted that the direction of DSM 32 movement in this and subsequent views is from right to left, as illustrated by the direction arrow P.

Figure 3A:
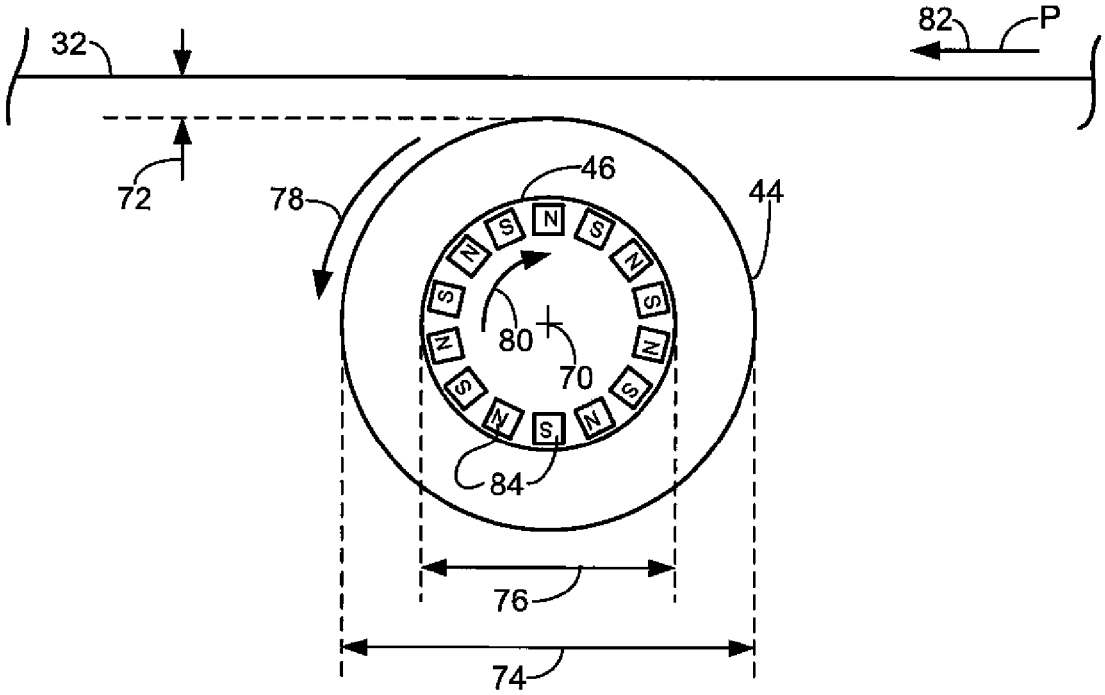
FIG. 3A schematically illustrates an embodiment of a development station having a rotating shell and rotating magnetic core which is operable to reduce development banding.
Figure 3B:
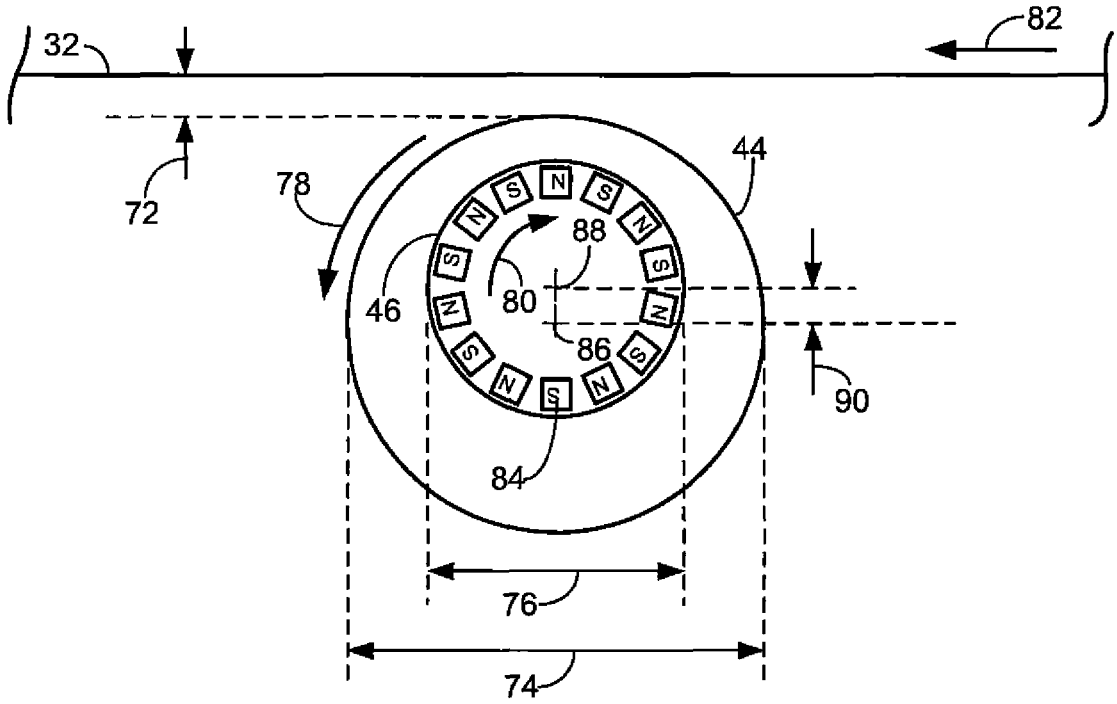
FIG. 3B schematically illustrates another embodiment of a development station having a rotating shell and rotating magnetic core which is operable to reduce development banding.

A variety of development station configurations are available having a rotating shell 44 and a magnetic core, particularly a rotating magnetic core 46. For the purposes of the claimed invention, however, the geometry and operation of the rotating shell 44 and the rotating magnetic core 46, relative to the DSM 32 are the key elements in a system and method for reducing development station banding. The applicability of the claimed invention to a development station with a stationary magnetic core can be understood from the description of the invention in relation to a development station with a rotating magnetic core. FIGS. 3A and 3B, therefore, schematically illustrate embodiments of a development station having a rotating shell 44 and rotating magnetic core 46 which are operable to reduce development banding. In the embodiment of FIG. 3A, the rotating shell 44 and the rotating magnetic core 46 share a common axis 70, therefore, in this embodiment, there is no offset between the rotating shell 44 and the rotating magnetic core 46. The rotating shell 44 is spaced from the DSM 32 by a shell spacing distance 72. The rotating shell 44 has a shell diameter 74, and the rotating magnetic core 46 has a core diameter 76. The rotating shell 44 rotates at a shell rotation speed 78, and the rotating magnetic core 46 rotates in the opposite direction at a core rotation speed 80, which is equal to zero for a stationary magnetic core. The DSM 32 is moving at a process speed 82. The shell rotation speed 78, the core rotation speed 80, and the DSM speed 82 may each be controlled relative to one another, either by separate motor control or gearing arrangements known to those skilled in the art. The rotating magnetic core 46 has a certain number of alternating magnetic poles 84. In this particular embodiment, there are fourteen magnetic poles 84, but other embodiments could have different numbers of poles.

In the embodiment of FIG. 3B, the rotating shell 44 has a shell axis 86 and the rotating magnetic core 46 has a core axis 88. The shell axis 86 and the core axis 88 are separated by an offset 90, since the core axis 88 is closer to the DSM 32 than the shell axis 86. This offset 90 may be utilized in some embodiments as a way to have a different magnetic field strength on the rotating shell 44 near the DSM 32 versus on the rotating shell 44 near other portions of the development station. The rotating shell 44 is spaced from the DSM 32 by a shell spacing distance 72. The rotating shell 44 has a shell diameter 74, and the rotating magnetic core 46 has a core diameter 76. The rotating shell 44 rotates at a shell rotation speed 78, and the rotating magnetic core 46 rotates in the opposite direction at a core rotation speed 80. The DSM 32 is moving at a process speed 82. The shell rotation speed 78, the core rotation speed 80, and the DSM speed 82 may each be controlled relative to one another, either by separate motor control or gearing arrangements known to those skilled in the art. The rotating magnetic core 46 has a certain number of alternating magnetic poles 84. In this particular embodiment, there are fourteen magnetic poles 84, but other embodiments could have different numbers of poles.

Therefore, the known geometries regarding the development station are:

a) $d_{CORE}$=the core diameter 76

$$\text{b)}\quad r_{CORE} = \text{the core radius} = \frac{d_{CORE}}{2}$$

c) $d_{SHELL}$=the shell diameter 74

$$\text{d)}\quad r_{SHELL} = \text{the shell radius} = \frac{d_{SHELL}}{2}$$

e) spacing=shell spacing distance 72 f) offset=offset 90 between core axis and shell axis g) $num_{POLES}$=number of poles in the core Furthermore, the known, selectable, and/or controllable process setpoints for the print engine and/or the development station include:

h) $v_{PROCESS}$=process speed 82 of the photoconductor i) $v_{SHELL}$=shell rotational speed 78

$$\text{j)}\quad \omega_{SHELL} = \text{shell angular velocity in radians} = \frac{v_{SHELL}}{60}\cdot 2\pi$$

k) $v_{CORE}$=core rotational speed 80 l) $V_{SHELL}$=shell surface speed=$\omega_{SHELL}\ x\ r_{SHELL}$

A pole frequency, $freq_{POLE}$, may be determined as:

$$freq_{POLE} = \frac{v_{CORE}}{60}\cdot(num_{POLES})$$

where $v_{COPE}$ is measured in revolutions per minute (RPM) and $freq_{POLE}$ results in a number of pole flips per second. Similarly, a pole period, $period_{POLE}$, may be determined as:

$$period_{POLE} = \frac{1}{freq_{POLE}}$$

Knowing the pole period, we can determine the time a certain number of pole flips, x, takes:

$$time_x = x(period_{POLE})$$

Knowing the time for a certain number of pole flips ($time_x$) and the process speed ($v_{PROCESS}$), we can determine how far the dielectric support member moves in x number of pole flips ($DSMdist_x$):

$$DSMdist_x = time_x(v_{PROCESS})$$

Figure 4:
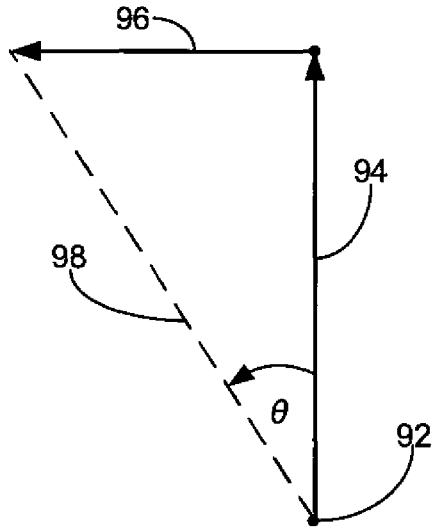
FIG. 4 schematically illustrates a moving spot on a dielectric support member and the geometry of a rotating magnetic core center relative to the dielectric support member and the moving spot.

Now, taking advantage of the geometries discussed above and the distance moved by the dielectric support member in x number of pole flips ($DSMdist_x$), we can determine the angular position of a spot on the DSM after the number of pole flips x. FIG. 4 schematically illustrates a moving spot on the DSM and the geometry of either the rotating shell center or rotating magnetic core center relative to the DSM and the moving spot. The determination is preferably made from a center 92 which corresponds to the axis of the rotating shell; however the center 92 could alternatively correspond to the axis of the rotating magnetic core in other embodiments. In the case where the center 92 is chosen to correspond with the axis of the rotating shell, the center 92 is perpendicularly spaced from the DSM by a center core spacing distance 94. The center core spacing distance ($dist_{CCS}$) in this situation may be determined as:

$$dist_{CCS} = r_{SHELL} + spacing$$

In the case where the center 92 is chosen to correspond with the axis of the rotating magnetic core, the center 92 is perpendicularly spaced from the DSM by a center core spacing distance 94. The center core spacing distance ($dist_{CCS}$) in this situation may be determined as:

$$dist_{CCS} = r_{SHELL} + spacing - offset$$

The distance moved by the dielectric support member in x number of pole flips ($DSMdist_x$) is illustrated as vector 96 in the process direction. A line 98 can be projected from the center of the rotating magnetic core 92 to the endpoint of the distance moved by the DSM in x number of pole flips, thereby defining $\theta_x$, the angular position of a spot on the DSM after x number of pole flips. Therefore, the angular position of a spot on the DSM after x number of pole flips equals:

$$\theta_x = \tan-1\left[\frac{DSM\,dist_x}{dist_{CCS}}\right]$$

Understanding the angular position $\theta_x$ of a spot on the DSM after x number of pole flips as well as the time $t_x$ taken for x number of pole flips, we can determine an effective approximate angular velocity ($\omega_{effective}$) of a spot on the DSM near the development nip (the region between the development roller and the DSM). In order to compute an effective angular velocity of a spot on the DSM near the development nip, the angular position $\theta_{x1}$ after a first number of pole flips can be subtracted from the angular position $\theta_{x2}$ after a second number of pole flips, and the result can be divided by the difference between the time $t_{x2}$ for the second number of pole flips minus the time $t_{x1}$ for the first number of pole flips. Therefore:

$$\omega_{effective} = \frac{\theta_{x2} - \theta_{x1}}{t_{x2} - t_{x1}}$$

The effective angular velocity, $\omega_{effective}$, will depend on which pairing of $x_1$ and $x_2$ number of pole flips are chosen for the calculation. In general, effective angular velocities calculated with higher numbers of pole flips will have slightly lower effective angular velocities. It is preferred to calculate the effective angular velocity with a smaller number of pole flips, rather than a larger number of pole flips. For example, the effective angular velocity could be calculated with the difference in angular positions and times after three pole flips and two pole flips. Alternatively, the effective angular velocity could be calculated with the difference in angular positions and times after two pole flips and one pole flip. In other embodiments, however, it may be preferable to use higher numbers of pole flips.

It should be noted that $\omega_{effective}$ is the effective angular velocity of a spot on the DSM in the vicinity of the development nip. Surprisingly, it has been discovered that this effective angular velocity of a spot on the DSM can be compared to the angular velocity of the rotating shell to determine a banding reduction ratio which can be used to manipulate system setpoints to minimize banding. The banding reduction ratio, $R_{BR}$ can be determined as follows:

$$R_{BR} = \frac{\omega_{effective}}{\omega_{SHELL}}$$

Figure 5A:
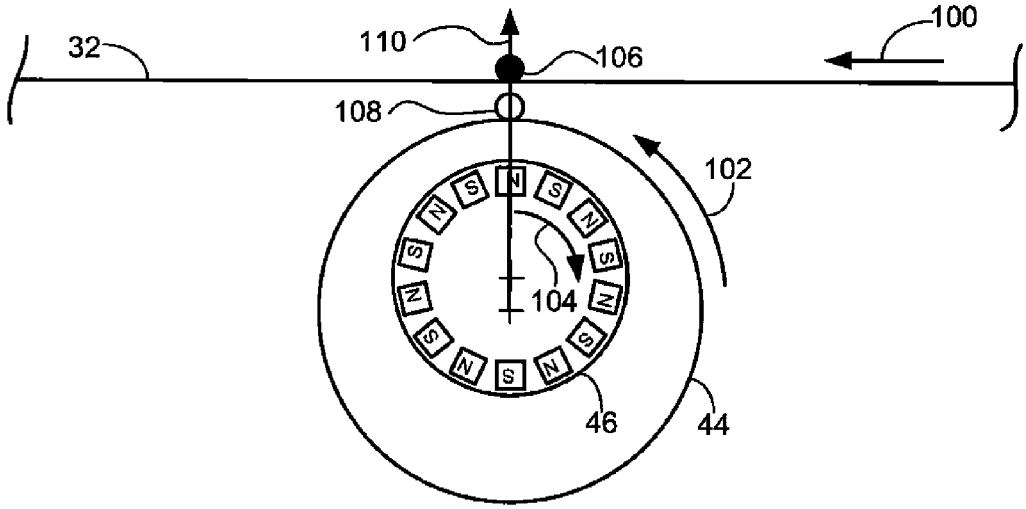
FIGS. 5A-5C schematically illustrate a moving spot on a dielectric support member relative to a moving spot on a rotating development shell after a number of pole flips for a rotating magnetic core.
Figure 5B:
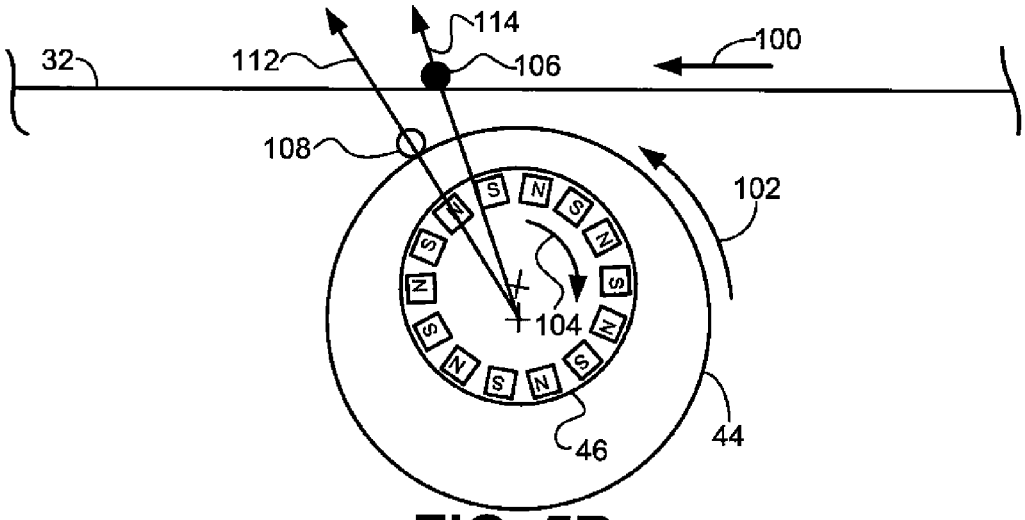
Figure 5C:
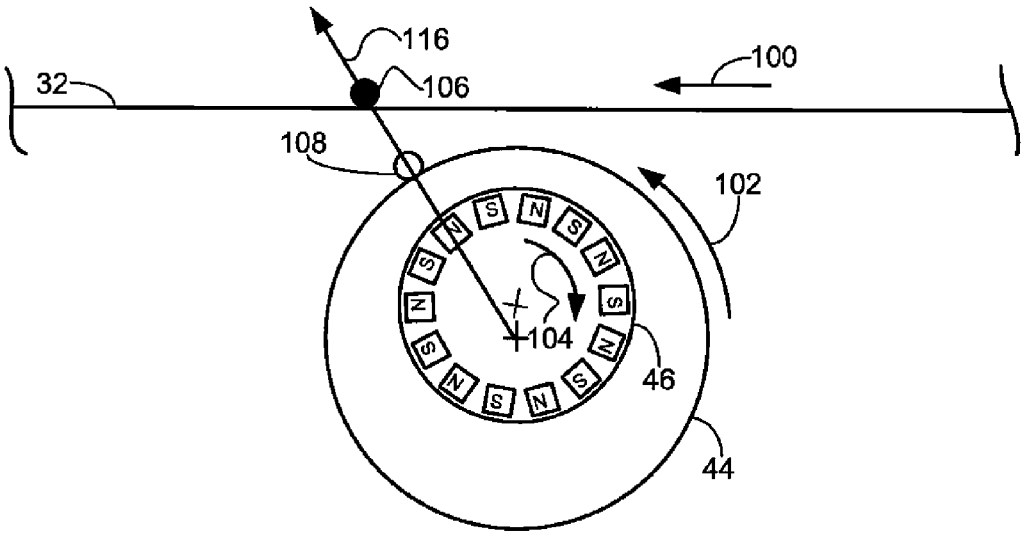

Empirically, it has been determined that the banding reduction ratio may be preferably set when the ratio is approximately 1.23:1 or 1.94:1. However, when the banding reduction ratio is approximately 1.47:1 or 3/2, banding occurs. Under this condition, where the ratio of the effective angular velocity of a spot on the DSM near the development nip to the angular velocity of the shell is approximately equal to a ratio of small whole numbers, banding has been shown to occur. When the banding reduction ratio differs from a ratio of small whole numbers by at least 5% and preferably 10%, banding is substantially minimized or eliminated. FIGS. 5A-5C schematically illustrates this behavior. In FIG. 5A, a DSM 32 is moving leftward 100 at a process speed. The rotating shell 44 is rotating counter-clockwise 102 at a shell rotation speed. Inside the rotating shell 44, a rotating magnetic core 46 is rotating clockwise 104 at a core rotation speed. In FIG. 5A, at an initial time, a spot 106 on the DSM 32 is aligned with a spot 108 on the shell 44 in alignment with a pole of the rotating magnetic core 46. The same vector 110 drawn from the center (axis) of the rotating shell 44 passes through both the spot 106 on the DSM and the spot 108 on the rotating shell 44.

FIG. 5B schematically illustrates a later time, when the spot 106 on the DSM 32 has moved leftward due to the process speed 100 of the DSM 32. The spot 108 on the rotating shell 44 has also moved counter-clockwise 102 with the rotation of the shell 44. The time chosen for FIG. 5B was such that when a vector 112 is projected from the center of the rotating shell 44 through the spot 108 on the rotating shell 44, the vector also passes approximately through a magnetic pole because the time chosen for FIG. 5B corresponds to a number of pole flips of the rotating magnetic core 46. A second vector 114 may also be projected from the center of the rotating shell 44 through the spot 106 on the DSM 32. As can be seen in FIG. 5B, the first vector 112 and the second vector 114 do not coincide because the effective angular velocity of the spot 106 on the DSM 32 does not approximate the angular velocity of the rotating shell 44. Under such conditions, banding is not likely to occur because there is likely to be an unevenly distributed range of depleted portions of the development nap adjacent to all points on the DSM 32.

As described above, however, either the rotational speed of the shell 44, the rotational speed of the magnetic core 46, and/or the process speed of the DSM 32 may be adjusted such that the effective angular velocity of a spot 106 on the DSM 32 is approximately equal to the angular velocity of the shell for a certain number of pole flips or to a multiple of the angular velocity of the shell. FIG. 5C, therefore, schematically illustrates an alternate later time versus FIG. 5A, when the spot 106 on the DSM 32 has moved leftward due to the process speed 100 of the DSM 32. The spot 108 on the rotating shell 44 has also moved counter-clockwise 102 with the rotation of the shell 44. The time and speeds chosen for FIG. 5C are such that when a vector 116 is projected from the center of the rotating shell 44 through the spot 108 on the rotating shell 44, the vector also passes through the center of a magnetic pole because the time interval between FIG. 5A and FIG. 5C corresponds to a number of pole flips of the rotating magnetic core 46. Since the effective angular velocity of the spot and the angular velocity of the shell are approximately equal, the same vector 116 also passes through the spot 106 on the DSM 32. Under such conditions, banding is more likely when situations similar to that shown in FIG. 5C occur because this unusual configuration duplicates the initial configuration shown in FIG. 5A.

A ratio different from 1:1, 3:2, or 2:1 is preferred for the ratio of the effective angular velocity of a spot on the DSM near the development nip versus the shell angular velocity. Specifically, it has been determined that banding can be reduced or eliminated when the banding reduction ratio is not a simple ratio of low whole numbers. For example, banding reduction ratios of 1.9:1 showed reduced banding. Conversely, it has been determined that non-unity banding reduction ratios of small integers such as 3:2 will produce banding, since for a finite nip width, different portions of the DSM will be developed with a few more or a few less depleted and non-depleted portions of the developer on the toning shell.

Experimental Data:

Banding reduction experiments were performed on an electrophotographic print engine capable of ninety pages per minute process speed. This process speed corresponded to 385.77 mm/sec dielectric support member (DSM) speed. The rotating development shell speed and rotating magnetic core speed were varied while the process speed was kept constant as follows:

| | $v_{PROCESS}$ | $v_{CORE}$ | $v_{sHELL}$ | $\omega_{SHELL} = \frac{v_{SHELL}}{60} \cdot 2\pi$ |
|---|---|---|---|---|
| Condition #1 | 385.77 mm/sec | 1029 RPM | 105.4 RPM | 11.03 rad/sec |
| Condition #2 | 385.77 mm/sec | 800 RPM | 82 RPM | 8.59 rad/sec |
| Condition #3 | 385.77 mm/sec | 1257 RPM | 128.9 RPM | 13.5 rad/sec |

The system geometries for all conditions were as follows:

| | |
|---|---|
| $d_{CORE}$ | 43.12 mm |
| $r_{CORE} = \frac{d_{CORE}}{2}$ | 21.56 mm |
| $d_{SHELL}$ | 50.8 mm |
| $r_{SHELL} = \frac{d_{SHELL}}{2}$ | 25.4 mm |
| spacing | 0.3556 mm |
| offset | 2.54 mm |
| $num_{POLES}$ | 14 |

The following calculations were then made for each of the test conditions:

| | Condition #1 | Condition #2 | Condition #3 |
|---|---|---|---|
| $freq_{POLE} = \frac{v_{CORE}}{60} \cdot (num_{POLES})$ | = 1029(14)/60<br>= 240.1 poles/s | = 800(14)/60<br>= 186.7 poles/s | = 1257(14)/60<br>= 293.3 poles/s |
| $period_{POLE} = \frac{1}{freq_{POLE}}$ | = 0.0041649 sec/pole | = 0.00535619 sec/pole | = 0.00340948 sec/pole |
| $time_x = x(period_{POLE})$ for one pole flip (x = 1) | = 0.0041649 s | = 0.00535619 s | = 0.00340948 s |
| $time_x = x(period_{POLE})$ for two pole flips (x = 2) | = 0.0083298 s | = 0.01071238 s | = 0.00681896 s |
| $DSMdist_x = time_x(v_{PROCESS})$ for one pole flip (x = 1) | =0.0041649 s<br>x385.77 mm/sec<br>= 1.60669 mm | = 0.00535619 s<br>x385.77 mm/sec<br>= 2.066257 mm | = 0.00340948 s<br>x385.77 mm/sec<br>= 1.315275 mm |
| $DSMdist_x = time_x(v_{PROCESS})$ for two pole flips (x = 2) | = 0.0083298 s<br>x385.77 mm/sec<br>= 3.213387 mm | = 0.01071238 s<br>x385.77 mm/sec<br>= 4.132515 mm | = 0.00681896 s<br>x385.77 mm/sec<br>= 2.63055 mm |
| $dist_{CCS} = r_{SHELL}$ + spacing − offset | = 25.4 + 0.3556 −2.54 = 23.2156 mm | 23.2156 mm | 23.2156 mm |
| $\theta_x = \tan - 1\left[\frac{DSMdist_x}{dist_{CCS}}\right]$ after one pole flip (x = 1) | $= \tan^{-1}\left[\frac{1.60669}{23.2156}\right]$<br>= .069097167 rad | $= \tan^{-1}\left[\frac{2.066257}{23.2156}\right]$<br>= 0.08876905 rad | $= \tan^{-1}\left[\frac{1.315275}{23.2156}\right]$<br>= 0.05659429 rad |
| $\theta_x = \tan - 1\left[\frac{DSMdist_x}{dist_{CCS}}\right]$ after two pole flips (x = 2) | $= \tan^{-1}\left[\frac{3.213387}{23.2156}\right]$<br>= 0.13754106 rad | $= \tan^{-1}\left[\frac{4.132515}{23.2156}\right]$<br>= 0.1761608 rad | $= \tan^{-1}\left[\frac{2.63055}{23.2156}\right]$<br>= 0.112828357 rad |
| Effective angular velocity of a spot on the DSM based on the difference between two pole flips and one pole flip: $\omega_{effective2-1} = \frac{\theta_2 - \theta_1}{t_2 - t_1}$ | = 16.4335 rad/s | = 16.3160 rad/sec | = 16.4934 rad/sec |
| Banding reduction ratio based on difference between two pole flips and one pole flip: $R_{BR} = \frac{\omega_{effective}}{\omega_{SHELL}}$ | = 16.4335/11.03<br>= 1.49<br>~3/2 ratio | = 16.3160/8.59<br>= 1.90<br>(not a simple ratio of low whole numbers) | = 16.4934/13.5<br>= 1.22<br>(not a simple ratio of low whole numbers) |
| Banding Results: | Banding | No Banding | No Banding |

Banding occurred when the banding reduction ratio was a ratio of low whole numbers because, for a finite nip width, different portions of the DSM will be developed with a few more or a few less depleted and non-depleted portions of the developer on the rotating shell. As seen above, if the banding reduction ratio was set to a number that is not a simple ratio of low whole numbers, such as 1.9, then visible banding was reduced because the DSM will be developed by adjacent portions of the rotating shell with a range of semi-depleted, non-depleted, and depleted developer.

Figure 6:
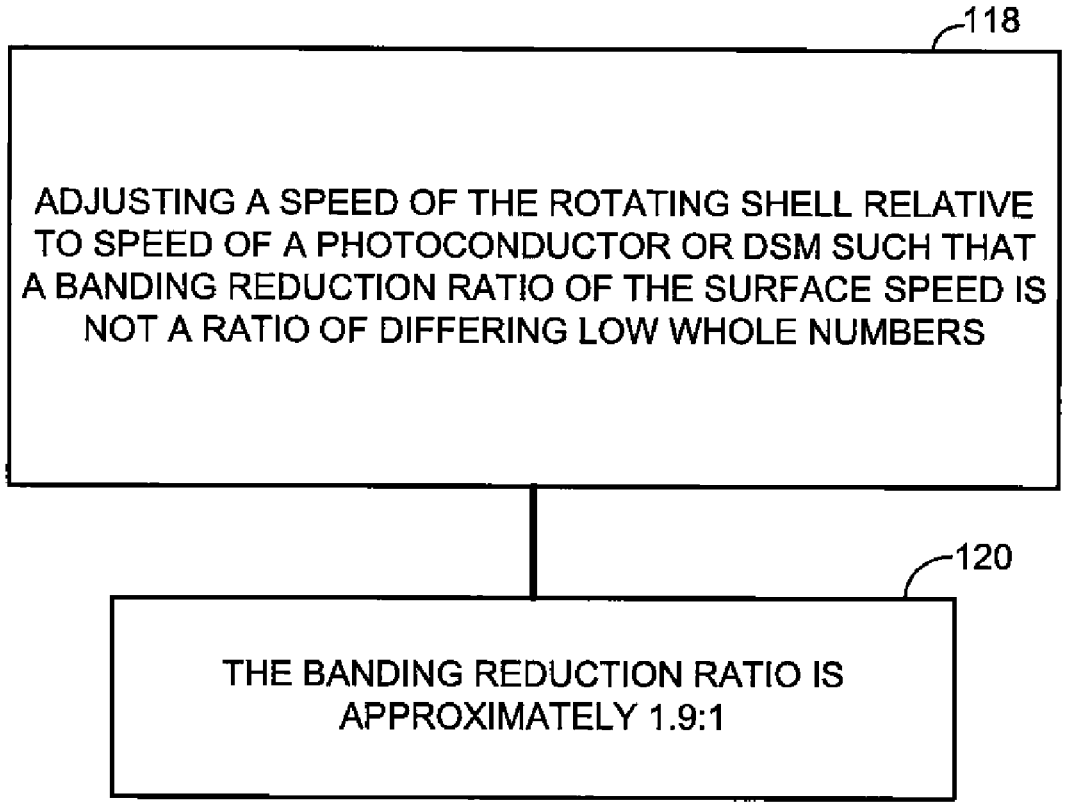
FIGS. 6-7 illustrate embodiments of methods which may be used to reduce high-frequency banding in an electrophotographic development station having a rotating shell and a rotating magnetic core.

Based on the examples and embodiments discussed above, and their equivalents, FIGS. 6-7 illustrate embodiments of methods which may be used to reduce high-frequency banding in an electrophotographic development station having a rotating shell and a rotating magnetic core. As the embodiment of FIG. 6 illustrates, high-frequency banding may be reduced in an electrophotographic development station having a rotating shell and a rotating magnetic core. In order to accomplish this, a rotating speed of the rotating shell is adjusted 118 relative to a process speed of a DSM such that a banding reduction ratio is not a ratio of differing low whole numbers. Ideally, the banding reduction ratio 120 would be less than approximately 1.95:1 or greater than approximately 2.05:1. High-frequency banding may be reduced in an electrophotographic development station having a rotating shell and a rotating magnetic core by adjusting 122 a rotating speed of the rotating shell relative to a rotating speed of the rotating magnetic core such that from the point of view of a spot on a dielectric support member (DSM) and a spot on the rotating shell in the center of a nip region of the DSM when a pole flip occurs, a point on the rotating shell with a similar history is substantially not in alignment with the DSM spot in the nip region when a subsequent pole flip occurs while the spot on the DSM is still in the nip region of the DSM and rotating shell.

Figure 7:
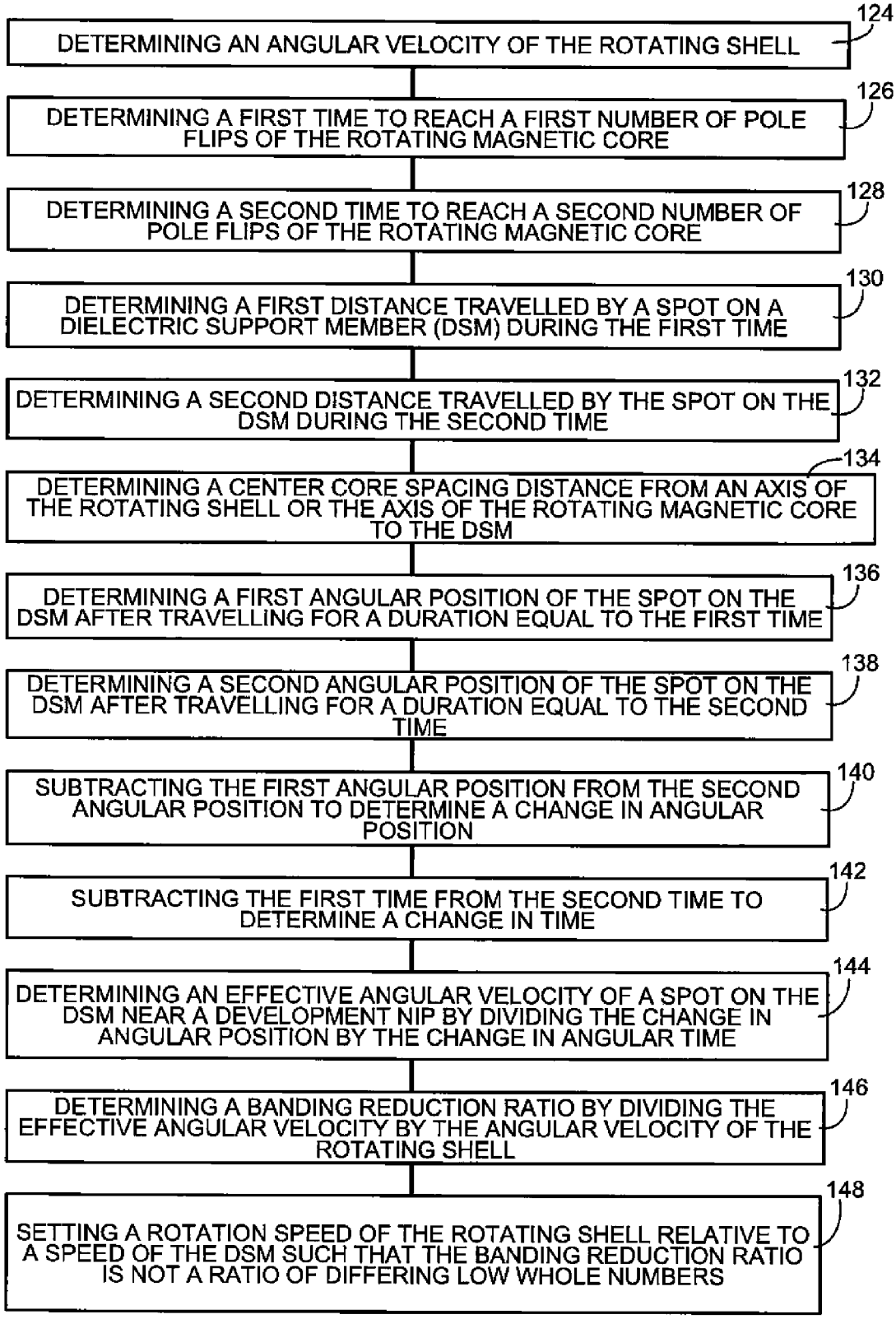

As FIG. 7 illustrates, high-frequency banding may be reduced in an electrophotographic development station having a rotating shell and a rotating magnetic core. In order to accomplish this, an angular velocity of the rotating shell is determined 124. This determination can be made from a calculation based on the speed (for example based on revolutions per minute) of the rotating shell. The determination can also simply a look-up, loading, or use of a stored value representing the angular velocity of the rotating shell. A first time to reach a first number of pole flips of the rotating magnetic core is determined 126. This first time may be based on either a pole frequency or a pole period as discussed above and is dependent on the speed of the rotating magnetic core, the number of magnetic poles in the rotating magnetic core, and the first number of pole flips. This determination can be a live calculation or the use of a look-up, loaded, or stored value representing the first time. A second time to reach a second number of pole flips of the rotating magnetic core is determined 128. This second time may be based on either a pole frequency or a pole period as discussed above and is dependent on the speed of the rotating magnetic core, the number of magnetic poles in the rotating magnetic core, and the second number of pole flips. This determination can be a live calculation or the use of a look-up, loaded, or stored value representing the first time.

A first distance traveled by a spot on a dielectric support member (DSM) during the first time is determined 130. This determination may be based on a multiplication of a process speed times the first time or may be a use of a look-up, loaded, or stored value. A second distance traveled by the spot on the DSM during the second time is determined 132. This determination may be based on a multiplication of a process speed times the second time or may be a use of a look-up, loaded, or stored value.

A center core spacing distance from an axis of the rotating shell or the axis of the rotating magnetic core to the DSM is determined 134. This determination may be a live calculation or a lookup of a stored value. A first angular position of the spot on the DSM, after traveling for a duration equal to the first time, is determined 136. The first distance traveled by the spot on the DSM and the center core spacing distance may be used in a trigonometric operation to determine the first angular position. A second angular position of the spot on the DSM, after traveling for a duration equal to the second time, is determined 138. The second distance traveled by the spot on the DSM and the center core spacing distance may be used in another trigonometric operation to determine the second angular position.

The first angular position is subtracted from the second angular position to determine 140 a change in angular position. The first time is subtracted from the second time to determine 142 a change in time. An effective angular velocity of a spot on the DSM near a development nip is determined 144 by dividing the change in angular position by the change in angular time. A banding reduction ratio is determined 146 by dividing the effective angular velocity of the spot on the DSM in the nip region by the angular velocity of the rotating shell. A rotation speed of the rotating shell is set relative to a rotation speed of the rotating magnetic core such that the banding reduction ratio is not a ratio of differing low whole numbers 148. Preferably, the banding reduction ratio is approximately 1.9:1 or 2.1:1, although other suitable ratios have been discussed above. The setting of the rotation speed of the rotating shell relative to the rotation speed of the rotating magnetic core may be accomplished by either adjusting only the rotation speed of the rotating shell, adjusting only the rotation speed of the rotating magnetic core, or adjusting both the rotations speeds of the rotating shell and the rotating magnetic core. As such, the methods are clearly tied to in a significant and meaningful manner to the operation of the development station.

The advantages of a method and system for reducing development station banding have been discussed herein. Embodiments discussed have been described by way of example in this specification. It will be apparent to those skilled in the art that the foregoing detailed disclosure is intended to be presented by way of example only, and is not limiting. Various other alterations, improvements, and modifications will occur and are intended to those skilled in the art, though not expressly stated herein. These alterations, improvements, and modifications are intended to be suggested hereby, and are within the spirit and the scope of the claimed invention. Additionally, the recited order of processing elements or sequences, or the use of numbers, letters, or other designations therefore, is not intended to limit the claims to any order, except as may be specified in the claims. Accordingly, the invention is limited only by the following claims and equivalents thereto.

PARTS LIST

30 print engine
32 dielectric support member (DSM)
34*a* driven roller
34*b* roller
34*c* roller
34*d* roller
34*e* roller

34*f* roller
34*g* roller
36 motor
38 primary charging station
40 exposure station (image writer)
40*a* writer
42 development station
42*a* backup roller
44 rotating shell
46 rotating magnetic core
48 transfer station
50 receiver sheet
52 biasing roller
54 fuser station
56 cleaning station
58 belt position sensor
60 sump region
62 toner
64 mixing device
66 donor roll
68 skiving blade
70 common rotating shell and rotating core axis
72 shell spacing distance
74 shell diameter
76 core diameter
78 shell rotation speed
80 core rotation speed
82 process speed
84 magnetic poles
86 rotating shell axis
88 rotating magnetic core axis
90 offset between core axis and shell axis
92 center point
94 center spacing distance
96 distance moved by DSM in x number of pole flips
98 projection line from center point to endpoint of the distance moved by the DSM in x number of pole flips
100 leftward direction
102 counter-clockwise direction
104 clockwise direction
106 spot on the DSM
108 spot on the rotating shell
110 starting vector
112 first scenario ending shell vector
114 first scenario ending spot vector
116 second scenario common ending spot and ending shell vector

What is claimed is:

1. A method for reducing high-frequency banding in an electrophotographic development station having a rotating shell and a rotating magnetic core, comprising:

subtracting a first angular position of a spot on a dielectric support member (DSM) in a nip region of the DSM after a first number of pole flips from a second angular position of the spot on the DSM after a second number of pole flips to determine a change in angular position;

subtracting a first time for the first number of pole flips from a second time for the second number of pole flips to determine a change in time;

dividing the change in angular position by the change in time to determine an effective angular velocity of the spot on the DSM in the nip region of the DSM;

dividing the effective angular velocity of a spot on a dielectric support member (DSM) in a nip region of the DSM by an angular velocity of the rotating shell to determine a banding reduction ratio; and adjusting a rotating speed of the rotating shell relative to a rotating speed of the rotating magnetic core such that the banding reduction ratio is not a ratio of differing low whole numbers.

2. The method of claim 1, wherein the banding reduction ratio is approximately 1:1.

3. The method of claim 1, further comprising:

dividing a distance moved by the DSM in the first time by a center core spacing distance to determine a first trigonometric ratio;

taking the arctangent of the first trigonometric ratio to determine the first angular position of the spot on the DSM after the first number of pole flips;

dividing a distance moved by the DSM in the second time by the center core spacing distance to determine a second trigonometric ratio; and taking the arctangent of the second trigonometric ratio to determine the second angular position of the spot on the DSM after the second number of pole flips.

4. The method of claim 1, further comprising:

multiplying a pole period by the first number of pole flips to determine the first time; and multiplying the pole period by the second number of pole flips to determine the second time.

5. The method of claim 3, further comprising:

adding a radius of the rotating shell plus a shell-to-DSM spacing to determine the center core spacing distance.

6. The method of claim 3, further comprising:

adding a radius of the rotating shell plus a shell-to-DSM spacing minus an offset between an axis of the rotating magnetic core and an axis of the rotating shell to determine the center core spacing distance.

7. The method of claim 3, further comprising:

multiplying the first time by a process speed to determine the distance moved by the DSM in the first time; and multiplying the second time by a process speed to determine the distance moved by the DSM in the second time.

8. A development system, comprising:

a rotating development shell;

a rotating magnetic core at least partially within the rotating development shell; and at least one drive configured to rotate the rotating development shell and the rotating magnetic core relative to each other such that a banding reduction ratio is not a ratio of differing low whole numbers, wherein the banding reduction ratio comprises an effective angular velocity of a spot on a dielectric support member (DSM) in a nip region of the DSM divided by an angular velocity of the rotating development shell, and the effective angular velocity of the spot on the DSM in the nip region of the DSM is determined by:

subtracting a first angular position of the spot on the DSM after a first number of pole flips from a second angular position of the spot on the DSM after a second number of pole flips to determine a change in angular position;

subtracting a first time for the first number of pole flips from a second time for the second number of pole flips to determine a change in time; and dividing the change in angular position by the change in time to determine the effective angular velocity of the spot on the DSM in the nip region of the DSM.

9. The development system of claim 8, wherein the banding reduction ratio is approximately 1:1.

10. The development system of claim 8, wherein the at least one drive is configured to rotate the rotating development shell and the rotating magnetic core relative to each other such that the banding reduction ratio is not a ratio of differing low whole numbers by varying a rotation speed of the rotating development shell.

11. The development system of claim 8, wherein the at least one drive is configured to rotate the rotating development shell and the rotating magnetic core relative to each other such that the banding reduction ratio is not a ratio of differing low whole numbers by varying a rotation speed of the rotating magnetic core.

12. The development system of claim 8, wherein:

a) the first angular position of the spot on the DSM after the first number of pole flips comprises:

1) dividing a distance moved by the DSM in the first time by a center core spacing distance to determine a first trigonometric ratio; and 2) taking the arctangent of the first trigonometric ratio to determine the first angular position of the spot on the DSM after the first number of pole flips; and b) the second angular position of the spot on the DSM after the second number of pole flips comprises:

1) dividing a distance moved by the DSM in the second time by the center core spacing distance to determine a second trigonometric ratio; and 2) taking the arctangent of the second trigonometric ratio to determine the second angular position of the spot on the DSM after the second number of pole flips.

13. A method for reducing high-frequency banding in an electrophotographic development station having a rotating shell and a rotating magnetic core, comprising:

determining an angular velocity of the rotating shell;

determining a first time to reach a first number of pole flips of the rotating magnetic core;

determining a second time to reach a second number of pole flips of the rotating magnetic core;

determining a first distance traveled by a spot on a dielectric support member (DSM) during the first time;

determining a second distance traveled by the spot on the DSM during the second time;

determining a center core spacing distance from an axis of the rotating shell or the axis of the rotating magnetic core to the DSM;

determining a first angular position of the spot on the DSM after traveling for a duration equal to the first time;

determining a second angular position of the spot on the DSM after traveling for a duration equal to the second time;

subtracting the first angular position from the second angular position to determine a change in angular position;

subtracting the first time from the second time to determine a change in time;

determining an effective angular velocity of a spot on the DSM near a development nip by dividing the change in angular position by the change in angular time;

determining a banding reduction ratio by dividing the effective angular velocity by the angular velocity of the rotating shell; and setting a rotation speed of the rotating shell relative to a rotation speed of the rotating magnetic core such that the banding reduction ratio is not a ratio of differing low whole numbers.

14. The method of claim 13, wherein the banding reduction ratio is approximately 1:1.

15. The method of claim 13, wherein setting the rotation speed of the rotating shell relative to the rotation speed of the rotating magnetic core such that the banding reduction ratio is not a ratio of differing low whole numbers comprises adjusting the rotation speed of the rotating shell.

16. The method of claim 13, wherein setting the rotation speed of the rotating shell relative to the rotation speed of the rotating magnetic core such that the banding reduction ratio is not a ratio of differing low whole numbers comprises adjusting the rotation speed of the rotating magnetic core.

* * * * *